US006994408B1

(12) United States Patent
Bunnell

(10) Patent No.: US 6,994,408 B1
(45) Date of Patent: Feb. 7, 2006

(54) HANDS-FREE PRODUCT ROLL DISPENSER

(76) Inventor: Donald Kenneth Bunnell, 575 Ridgeway, St. Joseph, MI (US) 49085

( * ) Notice: Subject to any disclaimer, the term of this patent is extended or adjusted under 35 U.S.C. 154(b) by 210 days.

(21) Appl. No.: 10/604,757

(22) Filed: Aug. 14, 2003

(51) Int. Cl.
*B65H 61/00* (2006.01)

(52) U.S. Cl. ..... 312/34.8; 83/211

(58) Field of Classification Search ..... 312/34.8, 312/34.1; 225/10, 11; 83/205, 208, 211, 83/209, 649; 242/564, 564.1, 564.4
See application file for complete search history.

(56) References Cited

U.S. PATENT DOCUMENTS

| | | | | |
|---|---|---|---|---|
| 3,730,409 A | | 5/1973 | Ratti | |
| 3,779,641 A | * | 12/1973 | Hauck | 355/29 |
| 3,919,905 A | | 11/1975 | Hoffman | |
| 4,666,099 A | | 5/1987 | Hoffman et al. | |
| 4,738,176 A | | 4/1988 | Cassia | |
| 4,796,825 A | | 1/1989 | Hawkins | |
| 4,817,483 A | | 4/1989 | Armbruster | |
| 4,823,663 A | * | 4/1989 | Hamlin | 83/208 |
| 4,960,248 A | | 10/1990 | Bauer et al. | |
| 5,020,403 A | | 6/1991 | D'Angelo | |
| 5,107,734 A | | 4/1992 | Armbruster | |
| 5,452,832 A | | 9/1995 | Niada | |
| 5,772,291 A | | 6/1998 | Byrd et al. | |
| 6,105,898 A | | 8/2000 | Byrd et al. | |
| 6,293,486 B1 | | 9/2001 | Byrd et al. | |
| 6,315,474 B1 | | 11/2001 | Giles et al. | |

FOREIGN PATENT DOCUMENTS

| | | | | |
|---|---|---|---|---|
| GB | 795245 | * | 5/1958 | 83/211 |

* cited by examiner

*Primary Examiner*—James O. Hansen
(74) *Attorney, Agent, or Firm*—Jonathan R. Smith

(57) ABSTRACT

A hands-free paper product dispenser has two separate IR emitter and sensor circuits, one to feed paper product through the dispenser and the other to cut it, each interlocked to prevent one from running while the other is in operation. The length of paper dispensed is under complete control of the user. Paper is clamped above and below the cut to assure a clean cut, clamped gently to avoid tearing by wet hands, and released completely after product is taken from the machine to avoid sticking of product to machine surfaces. Dynamic electric braking is used in the circuitry to reduce noise and impact wear on dispenser parts.

20 Claims, 15 Drawing Sheets

HANDS-FREE PRODUCT ROLL DISPENSER

BACKGROUND OF INVENTION

Many consumable products are manufactured in the form of spirally-wound rolls, e.g., paper towels and gift wrap. While these products can be unwound from the roll entirely by hand, there are a number of devices in the prior art to aid in dispensing product from the roll. These range from simple support of the roll, such as a single upright spindle upon which the axis of the roll is vertically installed, to cabinets into which a product roll is placed and which have mechanisms for dispensing product.

For simplicity of further discussion, and because the most common product roll dispensed is paper or similar non-woven web material, the terms "paper", "paper towel" and "paper towel roll" will be used hereinafter instead of "product" and "product roll". However, it should be understood that the present invention can be adapted to virtually any spiral-wound sheet product.

Recent U.S. patents to Byrd, et al., specifically U.S. Pat. Nos. 5,772,291, 6,105,898 and 6,293,486, disclose electrically-driven paper dispensers incorporating a photocell which causes a motor to unroll paper when an object (such as a human hand) blocks light entering it. One patent (U.S. Pat. No. 4,738,176) combines electrically-actuated unwinding with electrically-actuated cutting; a bi-directional motor moves the paper when turning in one direction and cuts it when turning in the other direction.

The prior art does not, however, provide the user separate hands-free control of the amount of paper dispensed and the timing of cutting the paper off. There is a need for this because there are various conceivable circumstances in which the user may not be ready to take the paper as soon as the machine rolls it out to the desired length, or the user may decide after unrolling a certain length to further extend the amount of paper to be cut off.

Another problem with the prior art is that either the paper is released before the user is ready to take it, or the user has to pull too hard to take the paper from the machine. The latter can be a problem especially if the user's hands are wet.

Yet another problem with the prior art is that many dispensers are designed to handle only one specific paper, e.g., thin, low-cost hand towels. If other paper grades are used in these types of dispensers, feed and cutting problems may result. There is a need for a dispenser that can be used with all grades of commercial as well as household paper towels.

Yet another problem with prior art dispensers is that parts driven at high speed are stopped by surfaces, such as bumpers, in the machine, which leads to excessive noise and impact wear.

There is also room for simplifying mechanisms for the holding of the paper by machine parts during and after cutting, which is addressed by the present invention.

SUMMARY OF INVENTION

The invention described here is an electric-powered paper towel dispenser that uses one photocell circuit to unroll towel material to a user-defined length, and another photocell circuit to cut the towel material perpendicularly to the direction of unrolling at a time selected by the user. A simple and novel set of weighted clamping plates actuated by the cutter mechanism holds the paper for clean cutting and retains the cut towel until grasped by the user. Infrared emitters and photodetectors are used herein, but it should be understood that emitters of other frequencies of electromagnetic radiation and other types of sensors (e.g., photocells) may be substituted, without limitation.

Two embodiments are disclosed, one of which is a more compact version of the other and therefore has additional novel features.

An object of this invention is to provide hands-free unrolling and cutting of continuous paper towel sheet from a spiral wound product roll, with the unrolling and cutting steps to be actuated separately at the discretion of the user.

A second object of the invention is to allow the user to unroll as long a sheet as desired with a single hand motion or a succession of hand motions, and to cut the sheet off with a single additional hand motion.

A third object of the invention is to provide a simple mechanism for clamping the towel material securely for clean and straight perpendicular cutting, while at the same time holding the cut towel material for easy release when the user grasps it.

A fourth object of the invention is to provide a towel dispenser that can be used with any roll of commercial or household towel material, and still provide reliable dispensing, a clean cut, and a low incidence of jamming.

A fifth object of the invention is to provide a hands-free towel dispenser that uses little electric power and is therefore amenable to the use of batteries in situations where line power is not readily available.

DETAILED DESCRIPTION

Following is a detailed description of the invention, referring to the attached drawings, in which like features are referenced by like numerals in each of the drawings.

Figure 1A:
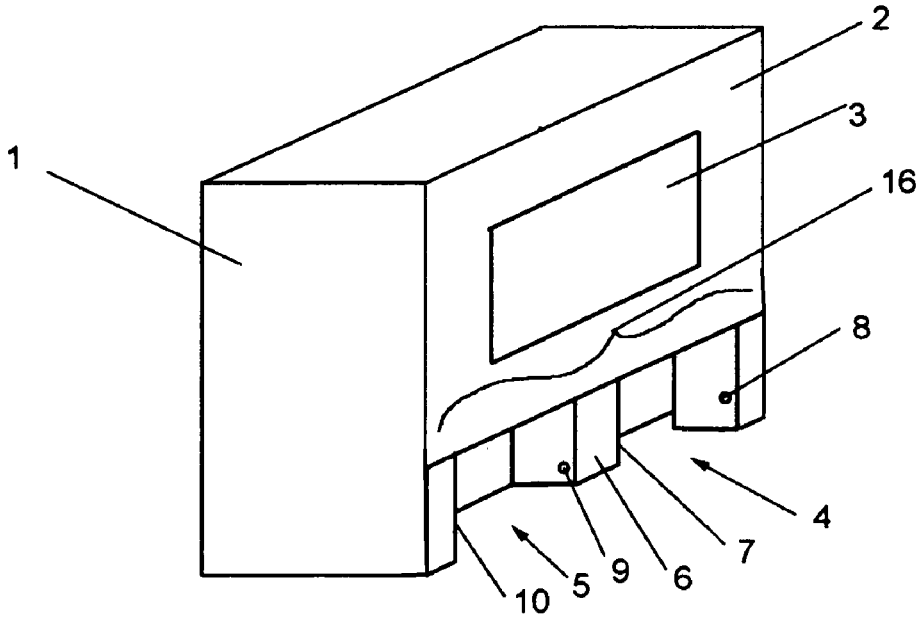
FIG. 1 is two perspective views of the first embodiment of the invention.
Figure 1B:
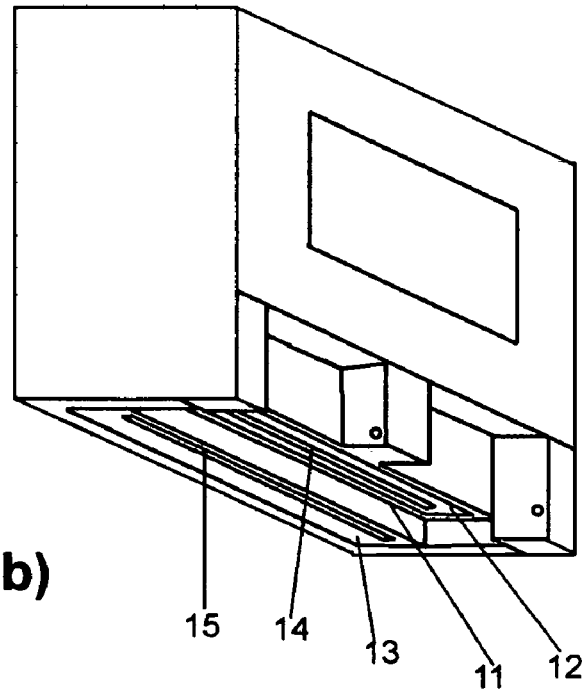

FIG. 1 is two perspective views of the exterior of the first embodiment of the invention. FIG. 1(*a*), a view from the upper left side of the invention, shows a cabinet 1 having a front door 2 with an optional transparent window 3. The door is designed to be opened from the front top edge, and a roll of paper product placed inside.

Key features of the invention, enabling hands-free control of both paper advance and cutting, are two separate infrared light emitters and sensors with infrared (IR) beams to be interrupted by human hands. Optical sensor recesses are therefore provided at the lower front of the cabinet 1_within a sensor housing 16: an advance recess 4 on the right side, and a cut recess 5 on the left. The beams of infrared light are emitted from a sensor emitter box 6, one toward the right from advance emitter 7 across recess 4 to advance command detector 8, and one toward the left from cut emitter 9 across recess 5 to cut command detector 10. In this discussion, the advance emitter/sensor pair is on the right, but the right or left placement of the two recesses and emitter/sensor pairs is immaterial and interchangeable. It is also well to note that this invention can be constructed and operate equally well if left and right are swapped in all parts of this specification and drawings, and that handedness is not meant to be a limitation.

FIG. 1(*b*) is a perspective view of the first embodiment from the lower left, showing features on the bottom of the first embodiment. The paper advancing mechanism is actuated by a user breaking the beam of light in recess 4 (to be discussed in greater detail below). Paper is dispensed through discharge slit 11 until the light beam ceases to be broken. Slit 11 is bounded front and rear by two L-shaped clamping plates—lower front clamping plate 12, and lower rear clamping plate 13. These two clamping plates are pivotably connected to cabinet 1 at either end so that they can pivot about horizontal axes parallel to the paper sheet. The clamping plates 12 and 13 also have cut into them longitudinal dust discharge slots 14 and 15, respectively.

Figure 2:
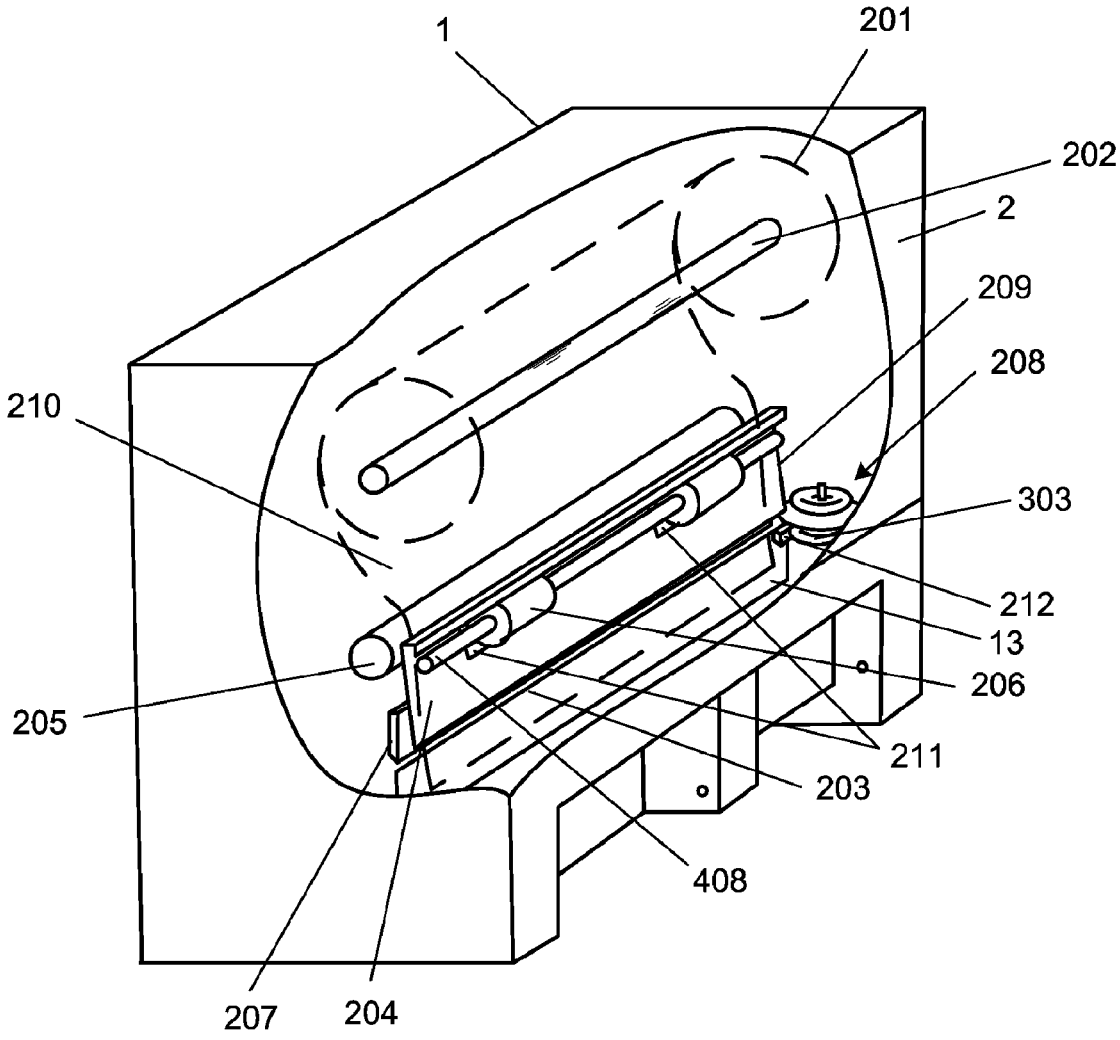
FIG. 2 is a perspective cutaway view of the first embodiment showing the arrangement of paper advancing parts.

FIG. 2 is a perspective cutaway view of the first embodiment showing the arrangement of paper product handling parts. A roll of paper 201 (shown in dashed lines because it is a consumable) is suspended from a smooth dowel 202. The dowel 202 is held at either end by a bracket (not shown here but shown as reference 401 in FIG. 4) on front door 2. Free end 203 of roll 201 is inserted downward through a loading slot (not shown in this figure but shown as reference 402 in FIG. 4) and suspended between a driven advance roller 205 and an idler, or pinch, roller 206. An upper clamping plate 204 hangs from pivot points 604 on each side wall of cabinet 1 between the advance roller 205 and the pinch roller 206, with rectangular holes 211 in it to permit the pinch roller 206 to contact the paper. Behind the paper 210 and below advance roller 205 is fixed cutting blade 207. When advance roller 205 is actuated by the user breaking the light beam in recess 4, a paper advance motor (not shown in this view) rotates advance roller 205 clockwise in this view and pulls paper 210 downward past fixed blade 207.

Also visible in this view at the far lower right inside the cabinet 1 is rotary cutter assembly 208, described in more detail below, in its parked position. In a cut cycle, this cutter assembly moves from right to left, cutting the paper, and eventually back to its parked position. Note for now that in its parked position, assembly 208 is rightward of the right end 209 of upper clamping plate 204. Note also that lower rear clamping plate 13 is shown, with spacer 212 affixed to its upper right corner. When the cutter assembly 208 is in its parked position, as shown, the lower drive roller 303 of the cutter assembly 208 presses against spacer 212, thereby urging lower rear clamping plate 204 farther to the rear. The function of these parts will be described in greater detail below.

Figure 3:
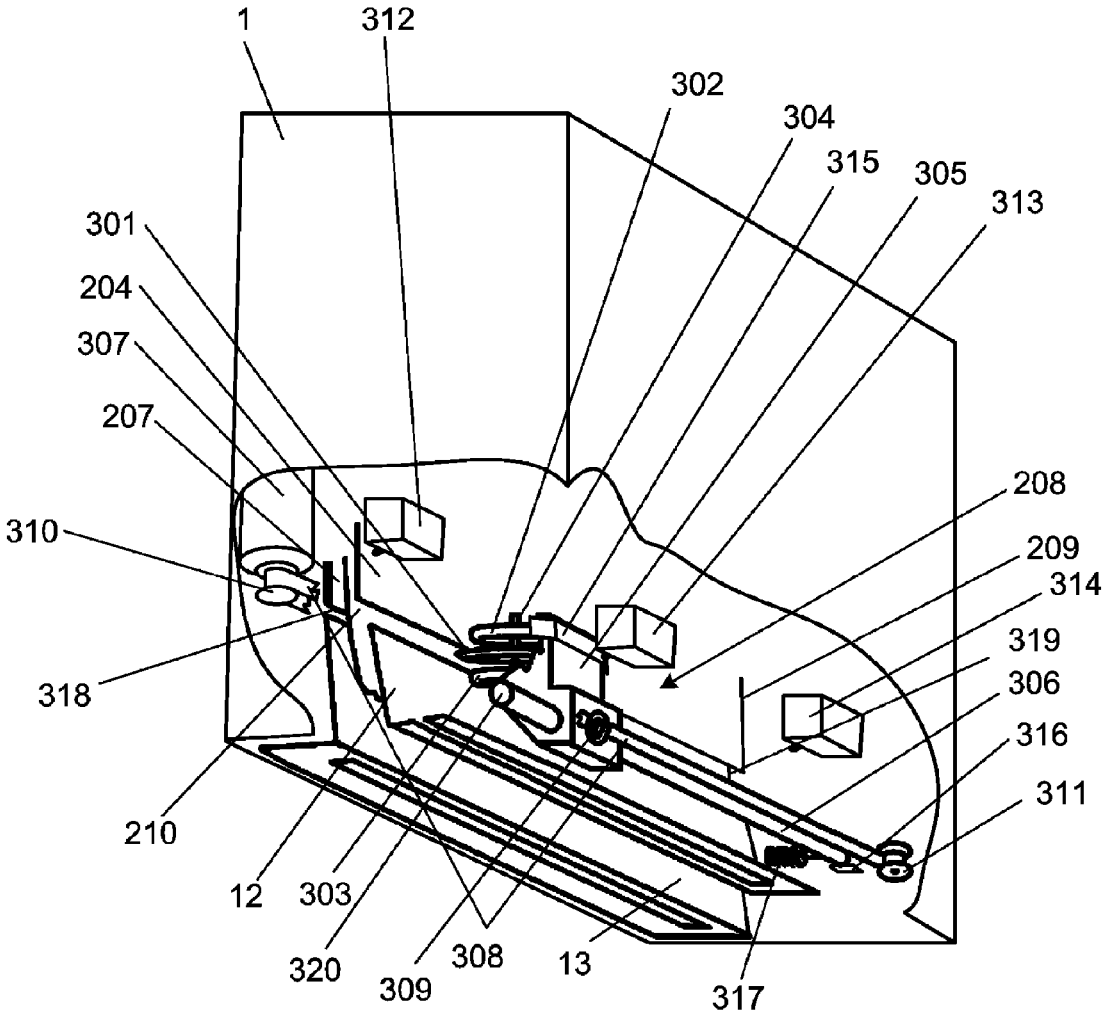
FIG. 3 is another perspective cutaway view of the first embodiment showing the arrangement of paper cutting parts.

FIG. 3 is a front cutaway view of the invention better showing the rotary cutter assembly 208. This assembly comprises a circular blade 301 sandwiched between a toroidal upper drive roller 302 and toroidal lower drive roller 303. The blade and rollers are fixed to a vertical shaft 304 rotatably held at both ends by housing 305 (cutaway here to better show the blade and rollers). This assembly 208 is slidably suspended upon a horizontal traverse rod 306, and is driven from side to side along this rod by electric cut motor 307. The cut motor 307 pulls the cutter assembly 208 by means of endless belt 308, to which assembly 208 is fixed by clamp 309, and which runs between drive pulley 310 and idler pulley 311. Idler pulley 311 is adjustably fixed to the cabinet 1 by a tensioner screw (not shown) to permit tension adjustment for belt 308.

Traverse rod 306 is not fixed at its ends to cabinet 1; rather, its ends rest on horizontal abutments which are fixed to the right and left walls of cabinet 1. Right hand abutment 316 is shown. An identical abutment on the other side of the cabinet is not shown because, for drawing clarity, traverse rod 306 is cut away at 320. Traverse rod 306 is also biased toward the rear of cabinet 1 by springs on either end; spring 317 at its right end and a like spring (not shown for clarity) at its left end. This spring suspension presses upper drive roller 302 on assembly 208 rearwardly against upper clamping plate 204, assuring that the total rearward force is constant at all points along the traverse rod 306. It also assures that circular blade 301 is pushed upwardly against edge 318 of fixed blade 207 with an even force at all points along the fixed blade 207, as explained in further detail below. These constant forces are desirable to assure clean, even cutting and reduce equipment wear.

The position of the cutter assembly 208 is governed by three microswitches: left side microswitch 312; center microswitch 313; and right side microswitch 314. These microswitches are tripped by foot 315 fixed to the front of cutter assembly 208. In its normal parked position, assembly 208 is at the far right of the traverse rod, and foot 315 presses right side microswitch 314. Upper drive roller 302 is rightward of the right end 209 of upper clamping plate 204, and circular blade 301 is rightward of the right edge 319 of the paper. To begin a cutting cycle, a user breaks the light beam in recess 5, turning on cut motor 307. This turns drive pulley 310 clockwise (as seen from the motor) pulling cutter assembly 208 to the left, as shown in FIG. 3. Upper drive roller 302 then engages, and rolls leftward onto, upper clamping plate 204, pushing it against the paper and clamping the paper between it and fixed blade 207. It also causes lower drive roller 303 to roll leftward off of spacer 212 of lower rear clamping plate 13, allowing lower rear clamping plate 13 to rotate forward by gravity. Lower drive roller 13 then also rolls onto lower front clamping plate 12, pushing lower front clamping plate 12 against the paper, thereby trapping the paper between it and lower rear clamping plate 13. The rolling of drive roller 302 against the upper clamping plate causes the circular blade 301 to revolve and begin to cut the paper right to left against lower edge 318 of fixed cutting blade 207.

Center microswitch 313 does nothing when it is tripped by assembly 208 passing leftward, because the circuit it opens is disconnected by a relay when cut motor 307 is running forward. Accordingly, nothing happens until foot 315 on assembly 208 reaches left microswitch 312 and trips it. This reverses the rotation of cut motor 307 and drives assembly 208 back to the right. The paper has now been cut completely across and is still being held fast by the clamping plates as assembly 208 moves rightward. Assembly 208 continues rightwardly until its foot 315 reaches center microswitch 313, which stops cut motor 307. Nothing further happens until the user pulls the paper from between lower front clamping plate 12 and lower rear clamping plate 13. This allows these two clamping plates to come into contact, closing a low-voltage circuit that starts cut motor 307 again. This moves assembly 208 to its rest position at the far right end of the cabinet, where it trips right microswitch 314, causing it to stop. When upper and lower drive rollers no longer rest on upper clamping plate 204 and front lower clamping plate 12, respectively, they separate from the fixed blade 207 and rear lower clamping plate 13, respectively, ending the cutting cycle. (How they separate is developed more fully in subsequent description.) All of the parts are thus restored to their original positions, leaving a gap through which the next portion of paper can freely descend upon the next actuation of the paper advance roller.

Figure 4:
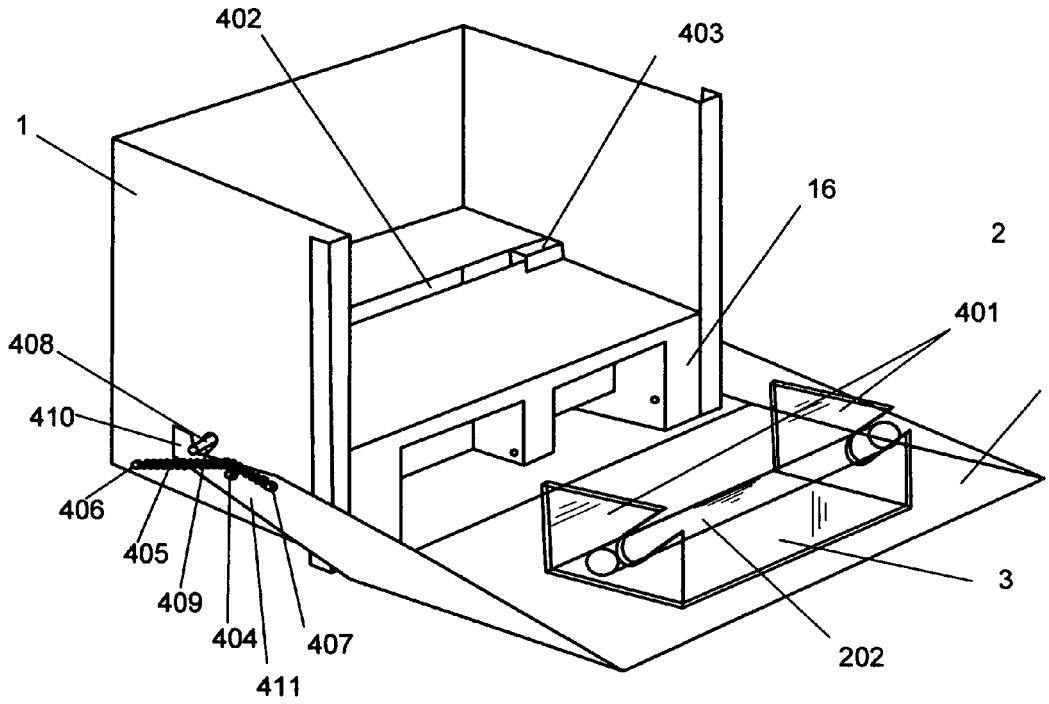
FIG. 4 is a perspective view of the first embodiment with the front door open.

FIG. 4 is a perspective view of the first embodiment with the front door 2 open, showing some further cabinet details. Smooth dowel 202 for supporting a roll of paper rests on both ends in bracket 401, which may, as shown, be composed of clear plastic and molded together with window 3. A horizontal cabinet slot 402 with end guides 403 (only right end guide visible) is provided to guide the free end of a roll of paper downward into the paper advancing and cutting mechanisms described above.

Door 2 is mounted pivotably on cabinet 1_by pin 404 and, when open, is held in that position by its weight. It is held in the closed position by spring 405 stretching between pin 406 on cabinet 1 and pin 407 on door 2. These parts, as shown on the left side of the cabinet 1 in this figure, are duplicated symmetrically on the opposite side of the cabinet even though not visible in this view.

Note that the left end of axle 408 on pinch roller 206 (see FIG. 2) protrudes through obround slot 409 in the left cabinet wall (likewise on the right side of the cabinet). Axle 408 is held at the upper end of slot 409 by tab 410 on door arm 411 when door 2 is open. This pulls pinch roller 206 (not visible) up and forwardly away from advance roller 205 (FIG. 2) so that paper can be fed between them when door 2 is open. When the door 2 is closed, door arm 410 descends, releasing pinch roller axle 408 so that the pinch roller 206 (FIG. 2) rests against the paper and the advance roller by its own weight.

Figure 5:
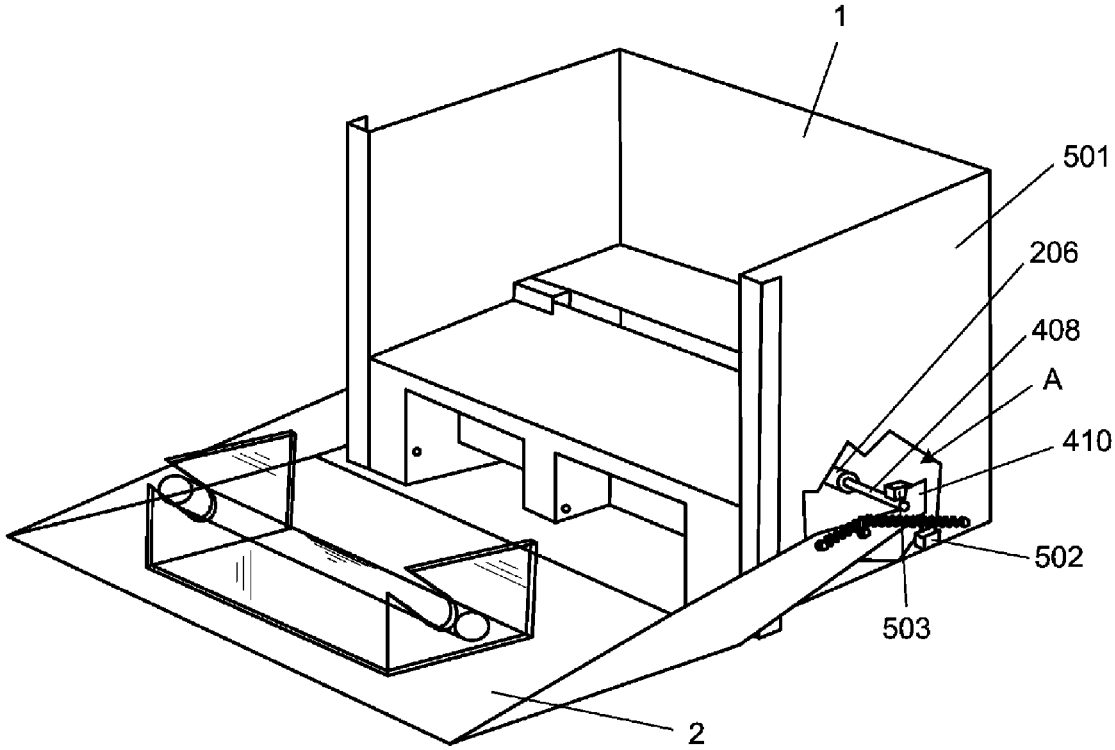
FIG. 5 is a perspective view from a different angle of the first embodiment with the front door open.

FIG. 5 is a perspective cutaway view of the first embodiment from a different angle showing some parts not duplicated on both sides. In particular, this view shows on the outside of right cabinet wall 501 a paper release microswitch 502. When door 2 is closed, door arm 411 presses against it, keeping the microswitch open. Whenever door 2 is even slightly opened, microswitch 502 closes and causes cutter assembly 208 (not shown) to move to its parked position. This releases all clamping plates and thus all paper, as shown more fully in subsequent drawings. This view also shows, within cutout "A" inside cabinet 1, master microswitch 503 fixed to the inside surface of cabinet right wall 501 above pinch roller axle 408. When door 2 is opened fully, as shown in this figure and in FIG. 4, tab 410 lifts axle 408 up to master microswitch 503, cutting off electric power to the entire unit. The reason paper release microswitch 502 is not used by itself as a master cut off is that it is undesirable to cut off all current until the cutter assembly is indexed fully rightward into its parked position. While it would be possible to arrange the circuitry in such a way as to cause the paper release microswitch 502 to kill all power to the unit only after the right side microswitch 314 is tripped (such as by, for example, using the paper release microswitch 502 to trigger a timer circuit that would allow the machine to run on until the cutter assembly hits the right side microswitch 314) it is safer to use a separate master microswitch for this purpose.

Figure 6:
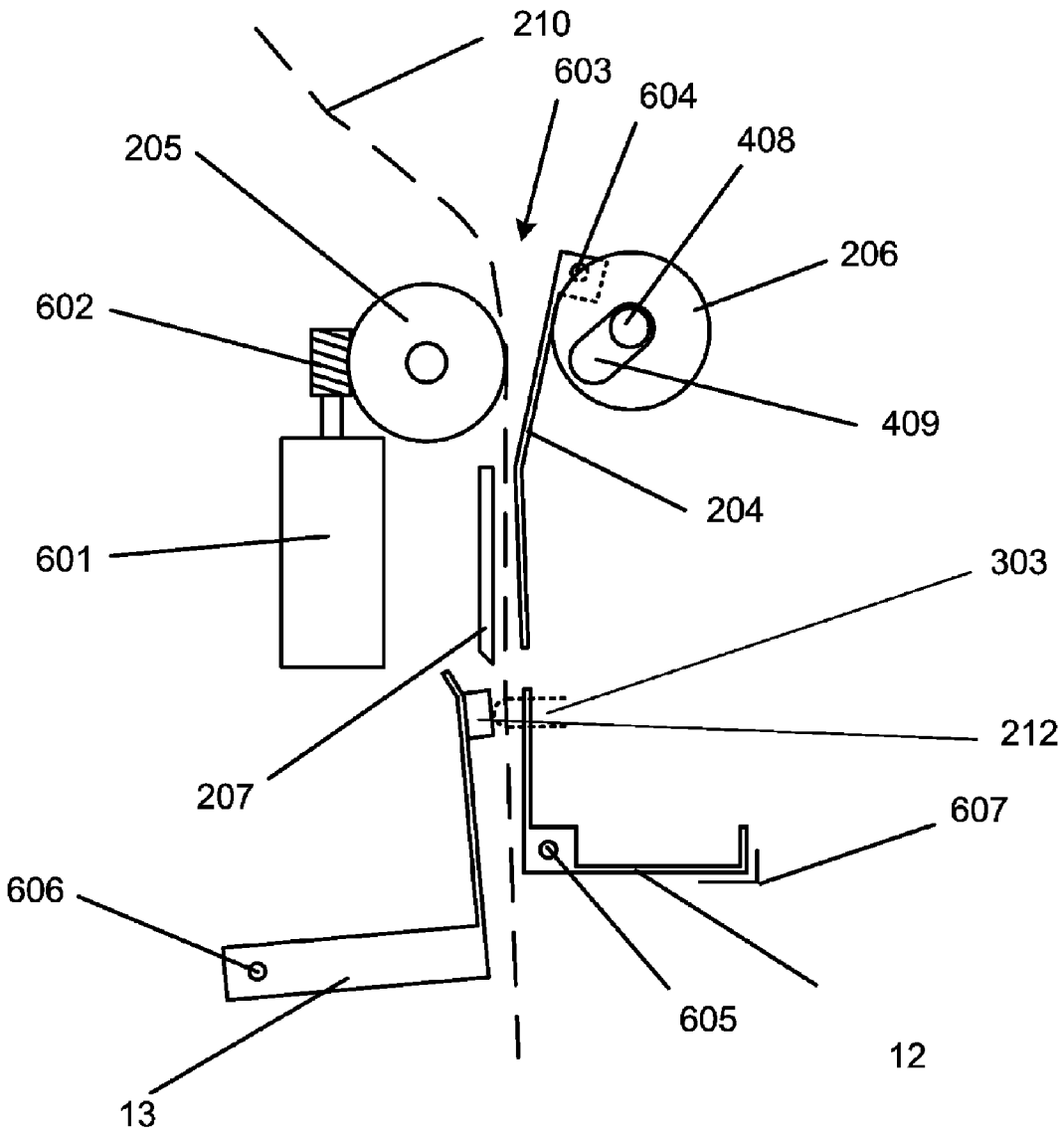
FIG. 6 is a left end view of the paper advancing and cutting apparatus showing the position of parts during loading of paper.

For additional clarity in understanding how the paper advancing and cutting parts interact, FIG. 6 is provided of a left end view of these parts inside the cabinet and their relationship to each other when the door (not visible in this figure) is open for addition of a product roll. Note that paper advance motor 601 is now shown, along with worm gear 602 connecting it to a gear (not visible) on the right end of advance roller 205.

When the cabinet door (reference 2 in FIG. 4) is open, axle 408 of pinch roller 206 is raised by a tab on the door (reference 410 in FIG. 4) to the position shown within obround slot 409. This creates a space 603 between the advance roller 205 and the pinch roller 206 into which paper 210 may be inserted. Upper clamping plate 204 hangs freely from upper pivot points 604 (on opposite walls of the cabinet) because the cutter assembly (behind the page in this figure) is not touching it. Upper clamping plate 204 is spaced away from fixed cutting blade 207 because it is hanging freely. Lower front clamping plate 12 is shown suspended by lower front pivot 605 on each end, and lower rear clamping plate 13 is shown suspended by lower rear pivot 606 on each end. Again because the cutter assembly (not shown) is in its parked position behind the page in this figure, lower front clamping plate 12 is resting by its own weight against front detent 607 on the cabinet wall. (This detent may, if desired, be located on the left face of cutter assembly 208, not shown.) In these positions, the lower clamping plates are also spaced apart. Thus, a clear path exists for the insertion of paper. Additional space is provided between the lower clamping plates because lower rear clamping plate 13 is urged toward the rear of the cabinet (leftward in this view) by spacer 212, which in turn is held slightly leftward in this view by lower drive roller 303.

Figure 7:
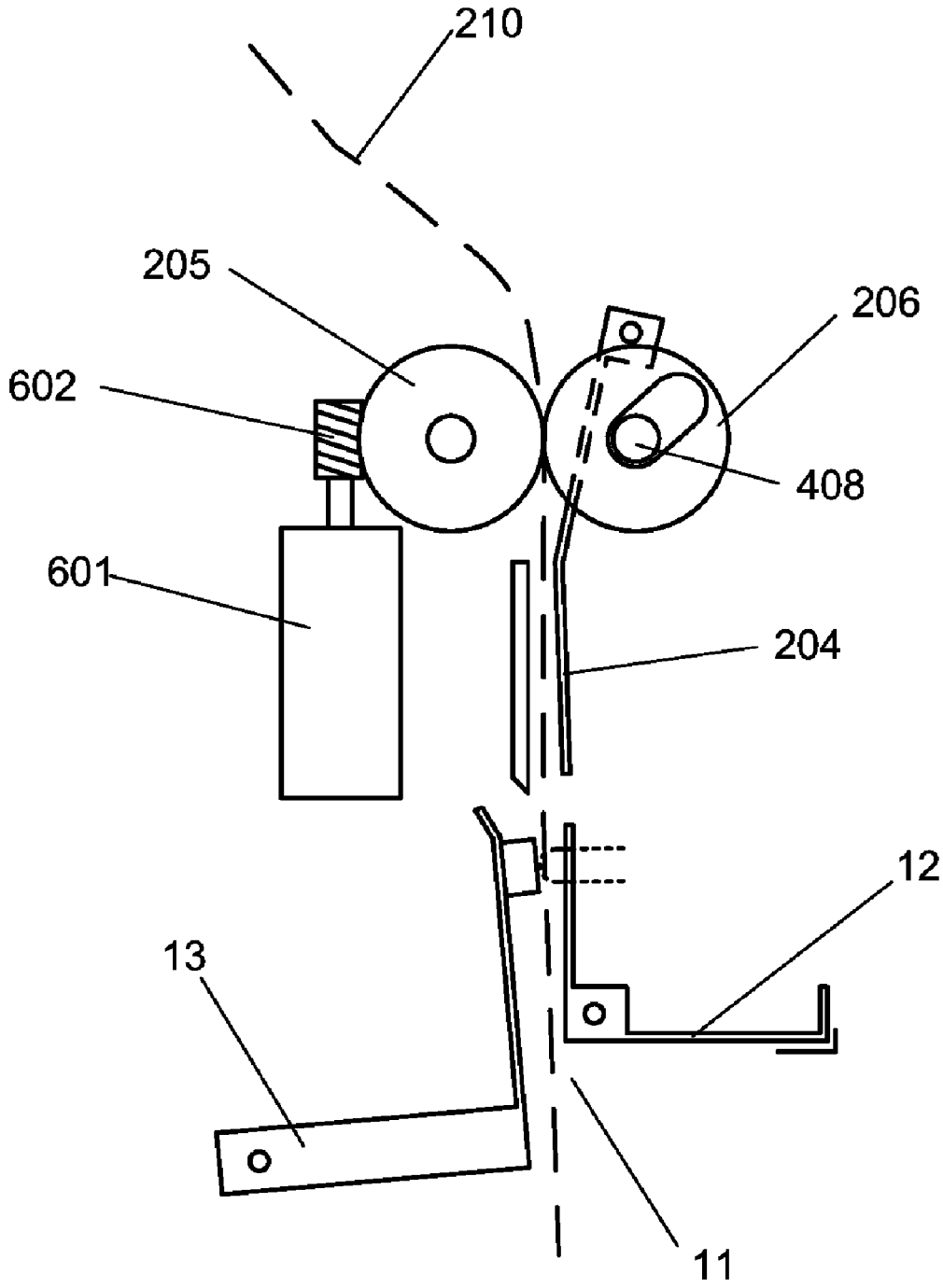
FIG. 7 is a left end view of the paper advancing and cutting apparatus showing the position of parts during the paper advance cycle.

FIG. 7 is an end view of the first embodiment when the cabinet door (not shown) is closed. The parts are in this same relationship when the paper is advancing, as well. With the door closed, door tab (reference 410 in FIG. 4) no longer holds up axle 408, allowing pinch roller 206 to fall by its own weight, pinching the paper sheet 210 into contact with advance roller 205. The cutter assembly remains in its parked position (behind the page) and therefore still does not impinge upon clamping plates 204 or 12. When paper advance is started by the user, advance motor 601 turns worm gear 602, which in turn drives advance roller clockwise, feeding paper sheet 201 downward and out dispenser slit 11.

Figure 8:
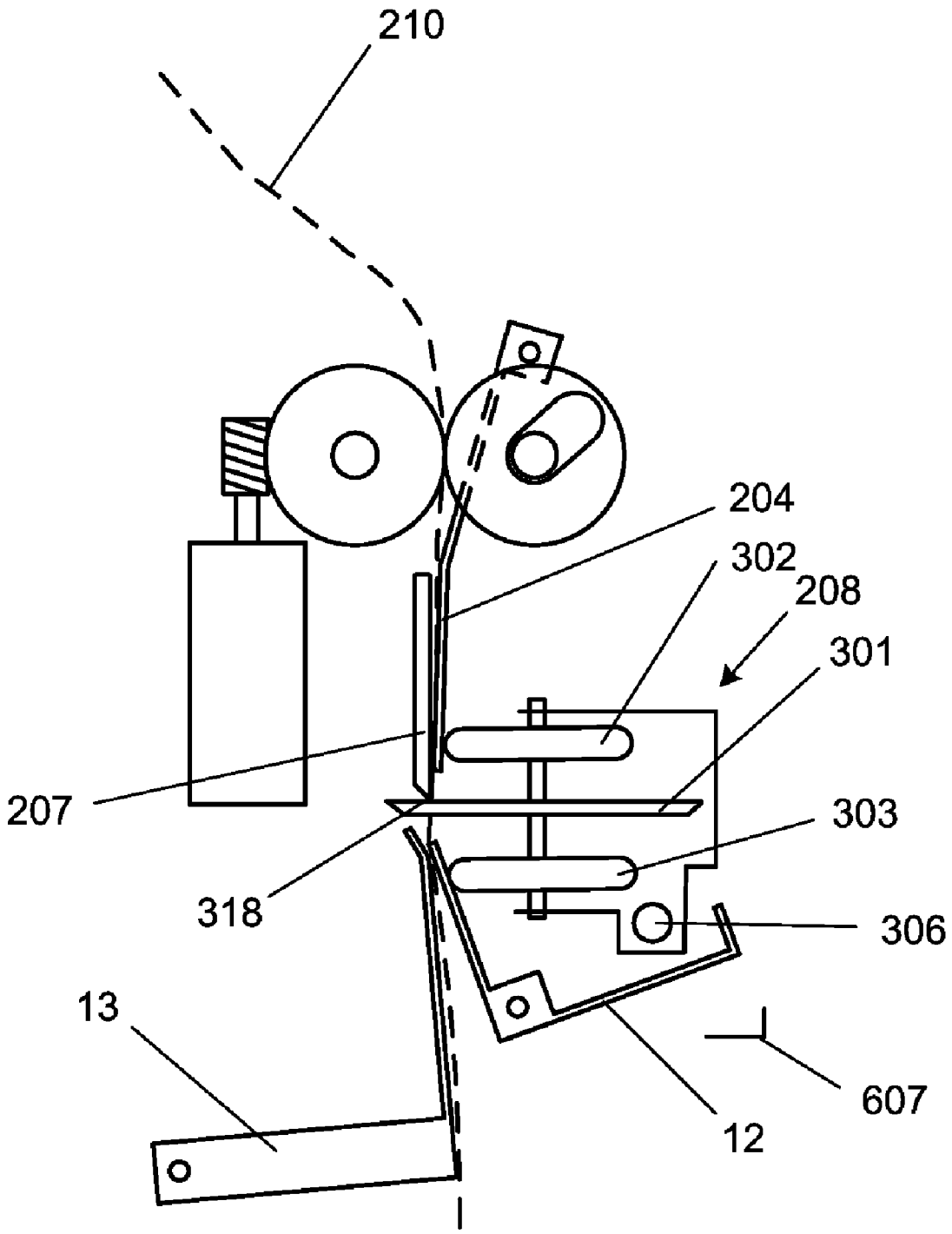
FIG. 8 is a left end view of the paper advancing and cutting apparatus showing the position of parts during the paper cutting cycle.

After paper advance stops, the user may start the cutting cycle, as shown in FIG. 8, at any time. When the cutting cycle begins, cutter assembly 208 leaves its parked position and moves in the out-of-the-page direction, bringing upper cutter drive roller 302 into contact with upper clamping plate 204 and lower drive roller 303 into contact with lower front clamping plate 12. The clamping plates are thus pushed to the left in this view. The paper sheet 210 is clamped both above and below circular blade 301, and it begins to be cut as circular blade 301 revolves against edge 318 of fixed blade 207. An important feature of this invention is the dual clamping of the paper along its entire width both above and below the cut, which creates a repeatably clean and straight cut. Another important feature of the invention is that the diameter of circular blade 301 is greater than either drive roller 302 or 303, causing the peripheral speed of circular blade 301 to be greater than the translational speed of the cutter assembly along fixed blade 207. This causes the paper fibers to be sliced through during cutting as well as merely being cut by simple shear. It also creates some self-sharpening action of the circular blade against the fixed blade. Note that all of the parts being pressed to the left by cutter assembly 208 pivot except for fixed blade 207. This means that the force exerted from right to left in this view by spring-loaded traverse rod 306 is met principally by the reaction of fixed blade 207 against upper drive roller 302. Thus the entire cutter assembly 208 is urged toward the clockwise direction in this view, but is stopped principally by the periphery of circular blade 301 pressing upwardly against fixed blade edge 318. This further assures cleanliness of cut. Importantly, it has been found by experimentation that cutter maintenance is minimized when the circular blade 301 is made of softer metal than fixed blade 207, specifically when the hardness difference is at least 4 Rockwell C units. Specifically, if fixed blade 207 is harder than circular blade 301 by at least this amount, it will tend to sharpen circular blade 301 every time circular blade 301 passes along fixed blade 207.

After the cutting cycle is finished, cutter assembly 208 stops near the center of the paper sheet and maintains the clamping plates 204, 12, and 13 in the positions shown until the user pulls the cut portion of the paper out of the dispenser. When the paper sheet is withdrawn from between lower rear clamping plate 13 and lower front clamping plate 12, lower rear clamping plate 13 pivots slightly clockwise of its own weight into direct contact with lower front clamping plate 12. A small electric current is thus permitted to flow between the two plates, triggering the cut motor (not shown) to move the cutter assembly 208 back to its parked position. The weight of the clamping plates 204 and 12 pivot them back to their positions in FIGS. 6 and 7 by gravity, and lower rear clamping plate 13 is again held farther open by lower drive roller 303.

It is important to note that except during the cutting cycle, there is at all times a gap between clamping plates 12 and 13 and between upper clamping plate 204 and fixed blade 207. As a result, between uses the machine puts no pressure on the paper at all save for the small weight of pinch roller 206. This is intentional, for it has been found by experimentation that certain types of paper towel adhere to surfaces over time under pressure and can cause paper feed problems in machines that are not made in accordance with the present invention.

FIGS. 9A through 9D show the circuit diagram of the first embodiment of the invention. Wire connections from one drawing to the next are indicated by lower case letters. This diagram is included here principally to provide additional support for certain claimed features of the invention even though electric parts and circuitry of the entire unit are shown. Specifically novel to the field of product roll dispensing is the employment of completely separate paper advance and paper cutting motors and actuation circuits. Also novel in the field is the use of electronic dynamic braking to prevent paper overrun and prevent impact stress from the oscillating cutter assembly (which moves across the machine at a high rate of speed). Following is a discussion of paper advance and the cutting cycle with reference to the circuitry. The circuit shown is powered by a 24-volt DC power supply. This can be either battery power or stepped-down and rectified AC power. The circuit could also, within the scope of the invention, be adapted readily to other sources of power.

Figure 9A:
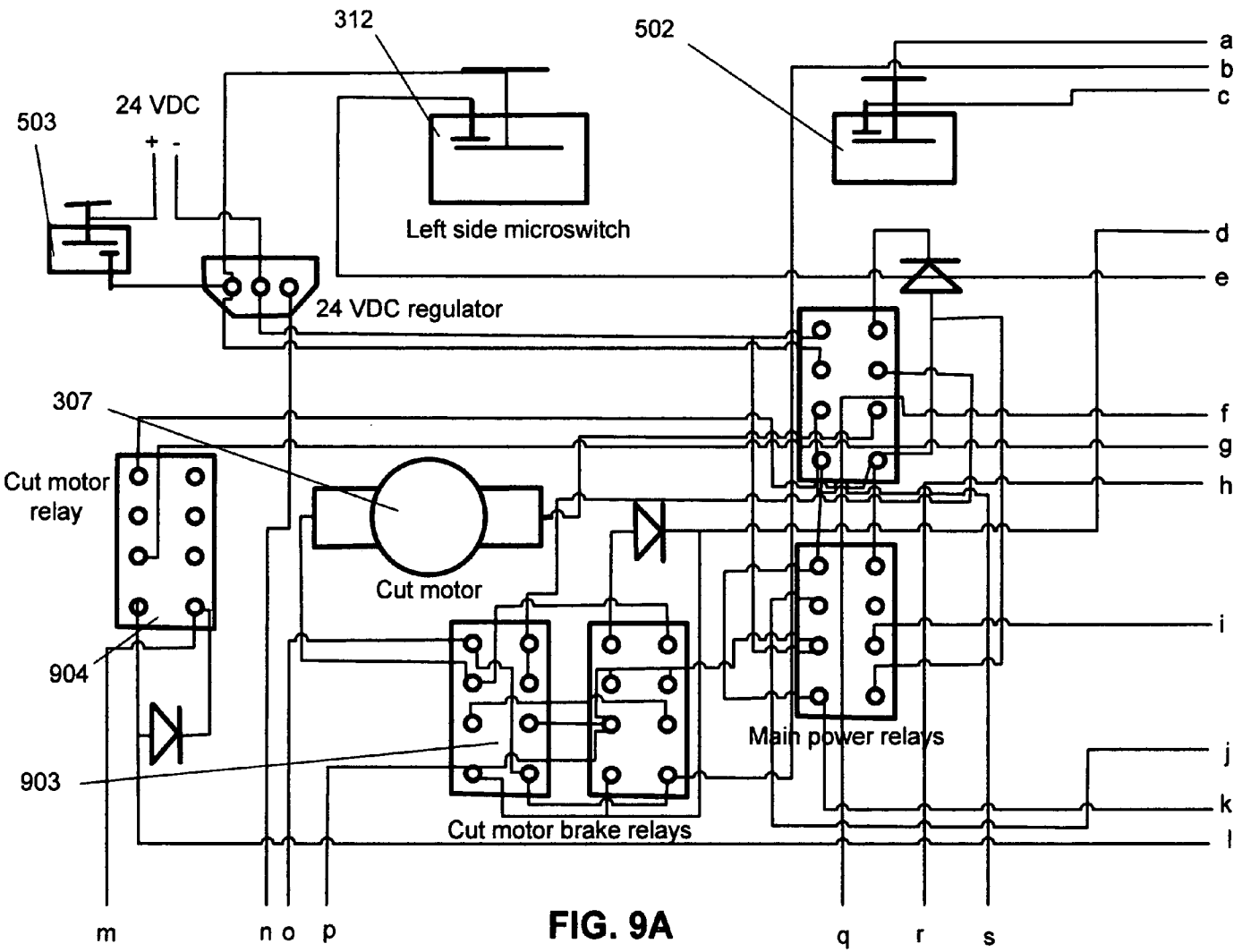
FIGS. 9A through 9D show the circuit diagram of the first embodiment.
Figure 9B:
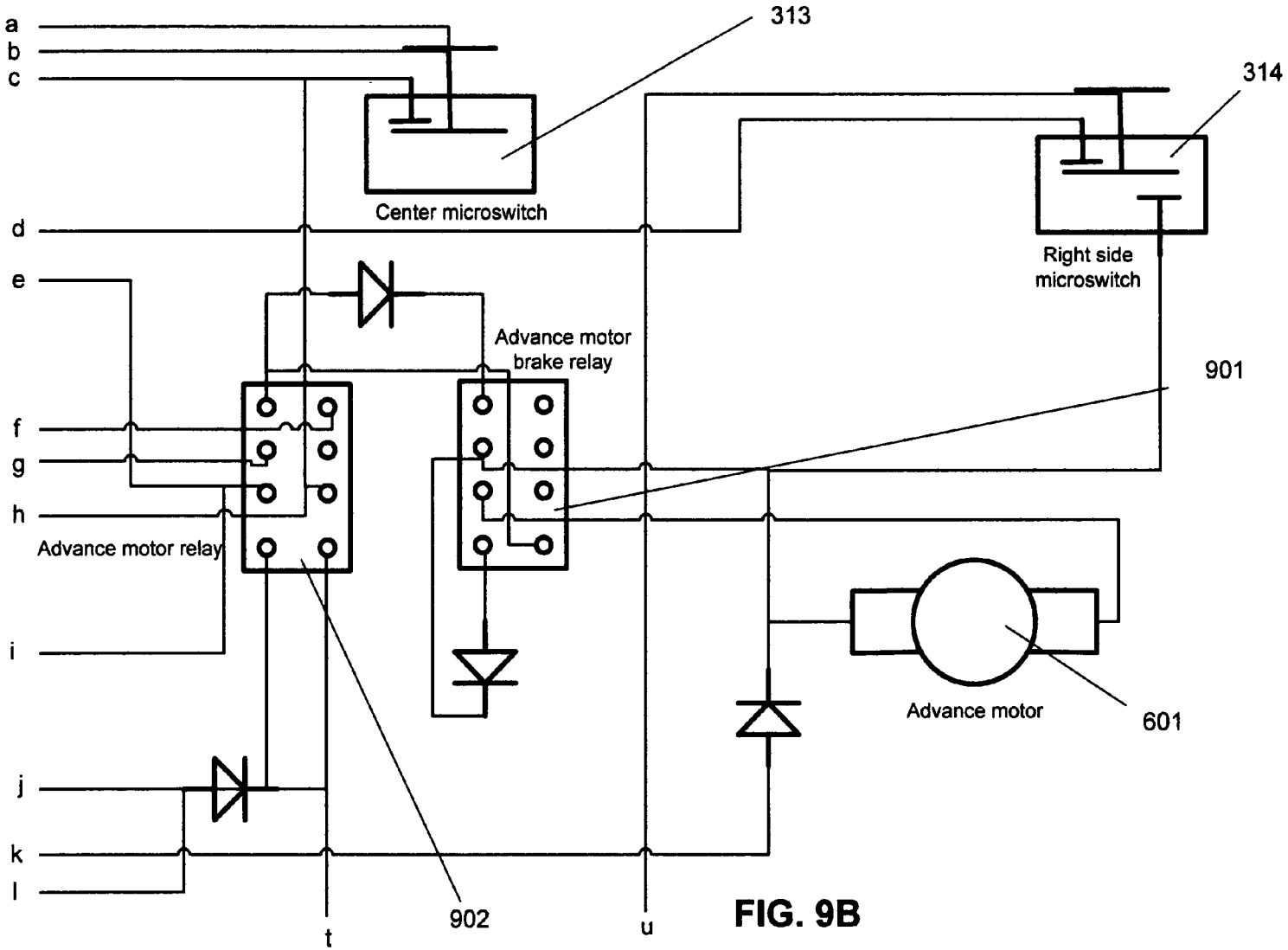

Paper advance is initiated by blocking light path 4, which allows current to flow through the advance motor relay 902 (FIG. 9B). If the cabinet door is closed and the cutter assembly (not shown) is parked, the normally open side of the right side microswitch 314 (FIG. 9B) is closed, the advance motor brake relay 901 (FIG. 9B) is thereby disabled, the advance motor relay 902 is energized, and advance motor 601 (FIG. 9B) turns, feeding paper through the machine. This continues uninterrupted until the user pulls his or her hand from light path 4 (FIG. 9D). At that time, the advance motor 601 is de-energized and advance motor brake relay 901 is energized, stopping the advance motor with minimal overrun of paper, which might otherwise occur due to mechanism inertia.

Figure 9C:
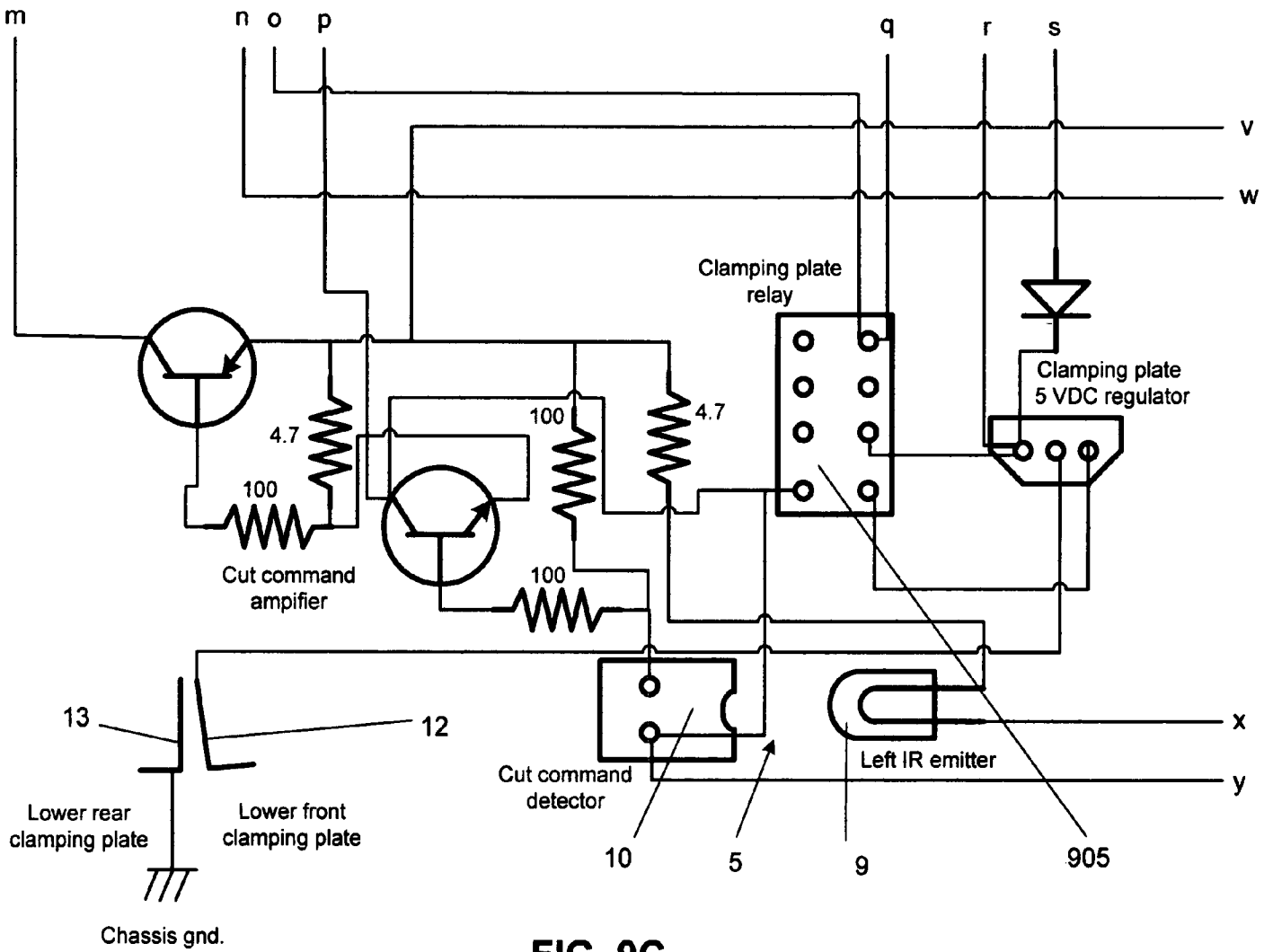
Figure 9D:
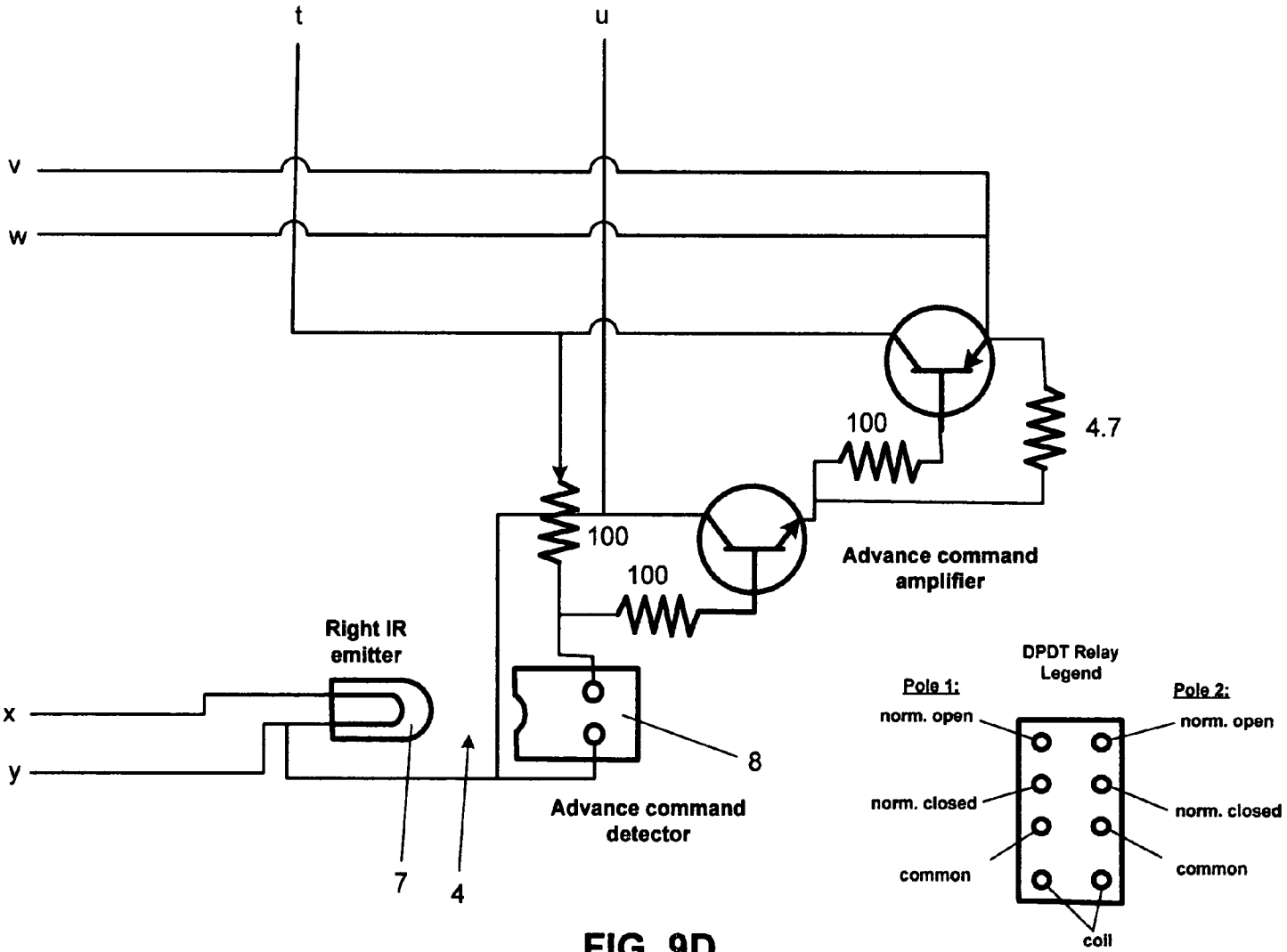

Initiation of the cut cycle begins with the user blocking light path 5 (FIG. 9C). If the cabinet door is closed and the cutter assembly is parked, the cut motor brake relays 903 (FIG. 9A) are disabled and the cut motor relay 904 (FIG. 9A) is energized. As long as left side microswitch 312 (FIG. 9A) is not pressed (which it is not when the cutter assembly is away from the left side of the machine), the cut motor 307 (FIG. 9A) starts out turning counterclockwise (seen from above in FIG. 3) and pulls the cutter assembly to the left, cutting the paper. When the cutter assembly (not shown) leaves right side microswitch 314, the advance motor relay is disabled, so that if the right light path 4 is broken for any reason while the cut cycle is on, no paper will feed. Nothing happens when the cutter assembly contacts center microswitch 313 (FIG. 9B) moving from right to left because it is disabled until the polarity of cut motor 307 is reversed by contact with left side microswitch 312. When the cutter assembly reaches the left side of the machine, left side microswitch 312 is pressed, energizing the cut motor brake relays 903, stopping the cut motor 307 with minimal impact on any machine parts and reversing current flow through it. The cutter assembly then moves in the opposite direction (left to right in FIG. 3) until it presses center microswitch 313, which again energizes the cut motor brake relays and de-energizes the cut motor. The cutter assembly is thus stopped in approximately the center of the machine, its drive rollers holding the clamping plates together.

If either the cut piece of paper is removed from between the lower clamping plates or the door is opened, the cut motor brake relays 903 are disabled and the reverse operation of the cut motor 307 restarts, sending the cutter assembly to its right side parked position. In the case of a cut piece of paper being removed from the machine, lower front clamping plate 12 (FIG. 9C) is grounded through lower rear clamping plate 13 (FIG. 9C), allowing current to flow from a 5-volt regulator 906 (FIG. 9C) to energize clamping plate relay 905 (FIG. 9C). This disables cut motor brake relays 903 and re-energizes cut motor relay 904, restarting cut motor 307 in the reverse direction and moving the cutter assembly to the right. If door 2 is opened, paper release microswitch 502 (FIG. 9A) closes, also disabling cut motor brake relays 903, re-energizing cut motor relay 904 and causing cut motor 307 to move the cutter assembly to the parked position. When the cutter assembly reaches right side microswitch 314, cut motor braking again takes place, stopping the cutter assembly in its parked position with minimal impact against machine parts such as the idler pulley (reference 311 in FIG. 3). All clamping plates are opened by the cutter assembly being in its parked position. The only parts remaining energized at this point are the two IR emitters 7 (FIG. 9D) and 9 (FIG. 9C). If door 2 is fully opened, as is necessary for adding a roll of paper or servicing the unit, master microswitch 503 (FIG. 9A) is opened, disconnecting all power.

Figure 10A:
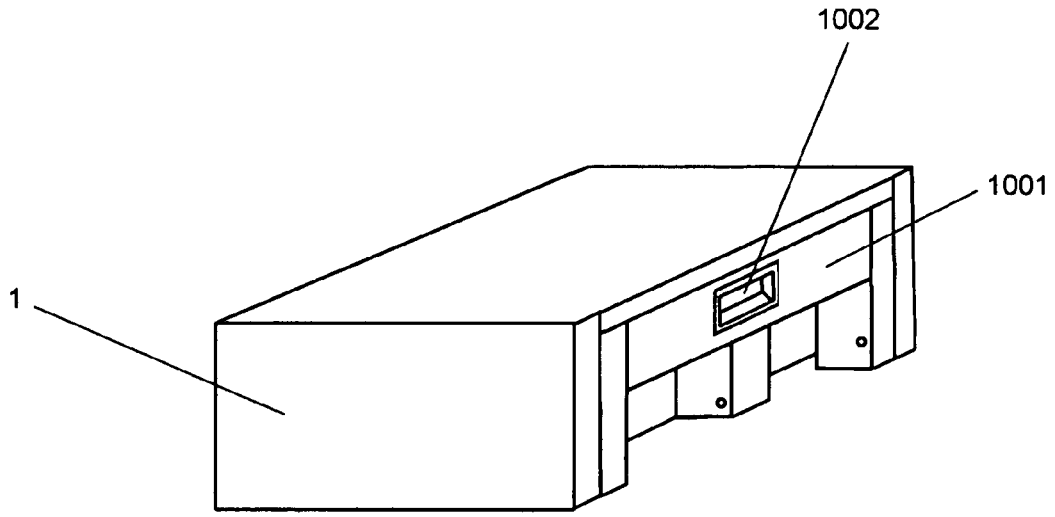
FIG. 10 is two perspective views of the second embodiment of the invention.
Figure 10B:
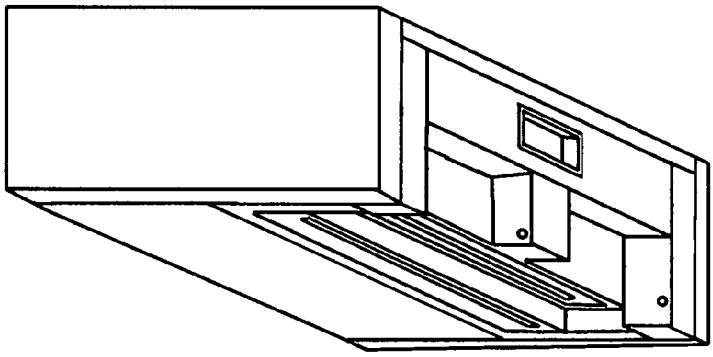

FIG. 10 is two perspective views of the second embodiment of the invention, consisting essentially of the same features of the first embodiment except principally that they are arranged in a lower profile. The lower profile allows installation of the invention in spaces of limited vertical extent such as beneath cabinets. Key external differences are a horizontally-elongated cabinet land a removable drawer portion 1001 with pull handle 1002.

Figure 11:
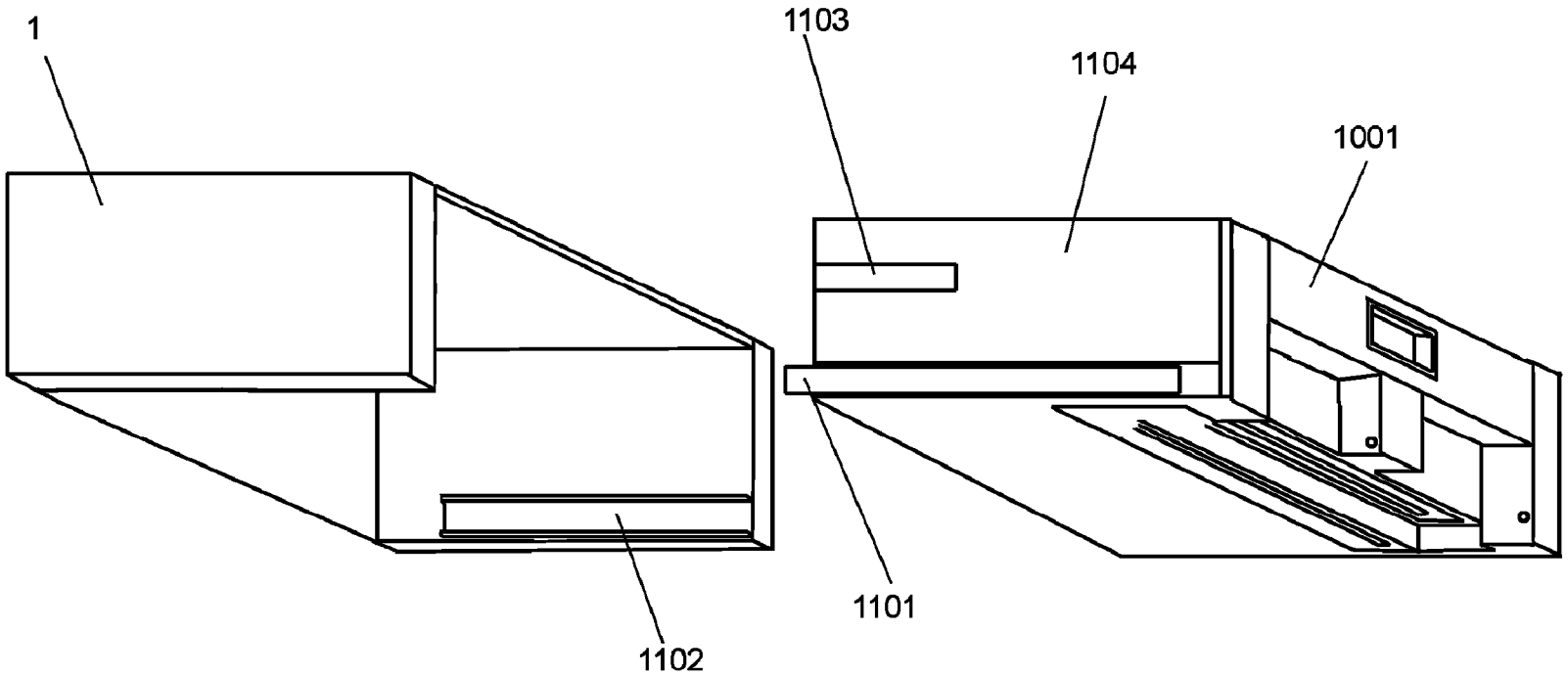
FIG. 11 is a perspective view of the second embodiment with its drawer removed.

FIG. 11 shows the drawer portion 1001 of the second embodiment pulled out of the cabinet 1 to reveal left drawer runner 1101 for insertion into a left runner track (not visible) and right drawer runner (not visible) for insertion into right runner track 1102. Note also electrical contact strip 1103, mounted flush in the left side cover plate 1004, which transmits electricity from a mating contact (not shown) inside the cabinet to all the electrical parts inside drawer 1001. Thus, paper can be installed and electrical components can be serviced in safety. Hence, the only differences between the electrical circuit of this second embodiment and that of the first embodiment are that a) master microswitch 503 is eliminated in favor of contact strip 1103, and b) paper release microswitch 502 moves from door actuation to pinch roller axle actuation, as explained further below.

Figure 12:
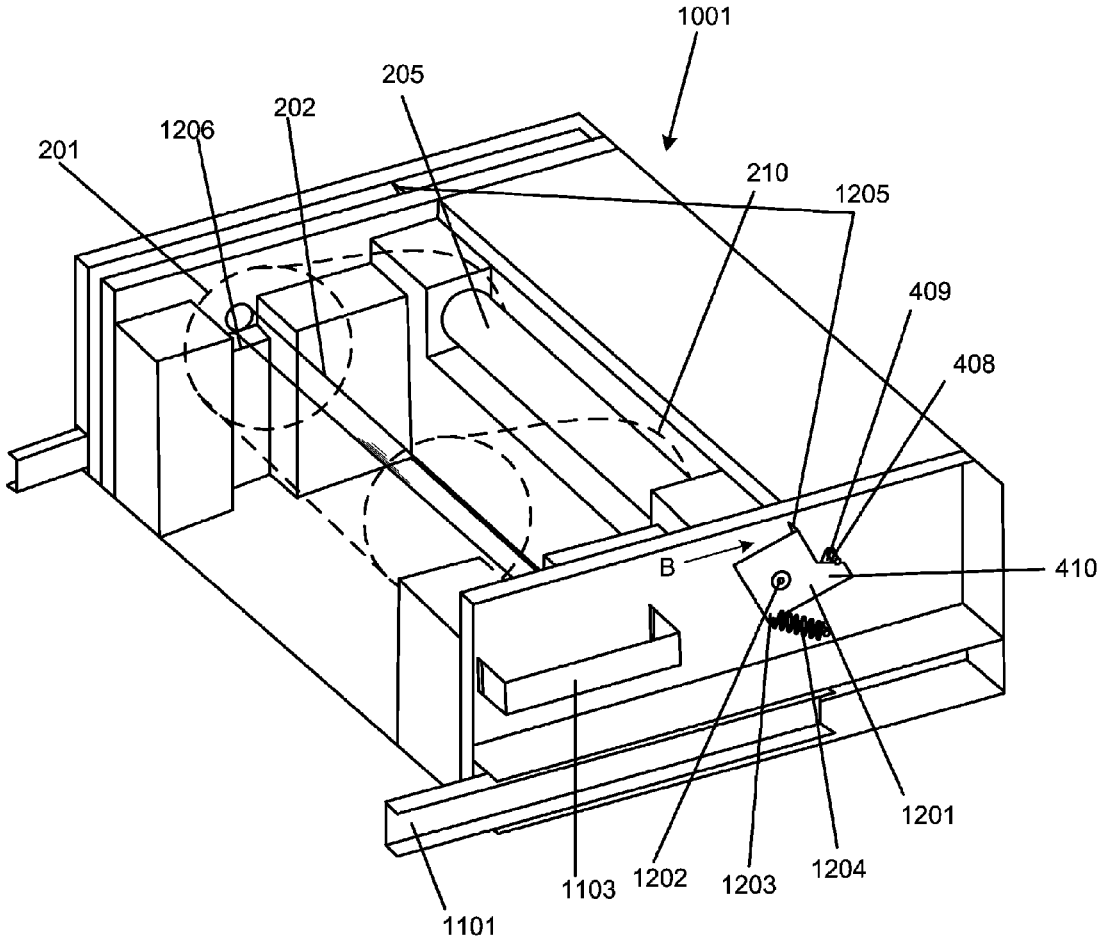
FIG. 12 is a perspective view of the drawer portion of the second embodiment.

FIG. 12 is a perspective view of the drawer portion 1001 of the second embodiment showing additional features distinguishing it from the first embodiment. This portion of the second embodiment contains all of the same parts and functions of the first embodiment, with four exceptions. First, the paper or product roll 201 is mounted behind, rather than above, the advancing and cutting assemblies. Second, The electrical interlock in this embodiment consists of contact strip 1103 instead of master microswitch 503 shown in FIG. 5. Third, the means for raising and lowering the pinch roller in the second embodiment is actuated by drawer movement rather than door movement. The left side cover plate (reference 1104 in FIG. 11) of the second embodiment has been removed to show the alternative mechanism for raising and lowering the pinch roller, which, as in the first embodiment, is identical on both left and right sides of the unit. In this embodiment, the axle 408 of the pinch roller is raised within the obround slot 409 by a spring-biased crank plate 1201. Crank plate 1201 is fastened to drawer 1001 pivotably about pin 1202, and has one corner 1203 also fastened to drawer 1001 by a spring 1204. When the drawer is out of the cabinet, spring 1204 biases the crank plate in a counterclockwise sense so as to cause tab 410 to raise pinch roller axle 408 to the top of obround slot 409. When the drawer 1001 is pushed back into the cabinet, a catch on the upper left inside of the cabinet (not shown) pushes against a tang 1205 on crank plate 1201 in the direction of arrow B, rotating the crank plate 1201 against the spring 1204 and allowing the pinch roller to descend into contact with the advance roller 205. Thus, when the drawer is out of the cabinet, the paper sheet 210 can be inserted downward past the cutter mechanism as in the first embodiment. The fourth difference between the two embodiments is that the paper release microswitch 502 in FIG. 5 is moved from below door arm 411 to a position above pinch roller axle 408 (not visible in FIG. 12). Thus, when drawer 1001 begins to be withdrawn, pinch roller axle 408 pushes upwardly against microswitch 502, moving the cutter assembly (not visible) to its parked position.

What is claimed is:

1. A sheet product roll dispenser, comprising:

a) an openable cabinet for holding a roll of spirally-wound sheet product, the spirally-wound sheet product having a free end;

the free end being releasably held in a nip between an advance roller and a pinch roller;

the advance roller being turned by an advance motor connected rotationally to the advance roller;

the advance motor being started and stopped by the blocking of a first electromagnetic beam by a user, so that the sheet product advances when the beam is blocked and stops when the beam is allowed to pass;

b) means for cutting the sheet product transversely to the direction of advancement;

the means for cutting the sheet product transversely comprising a cutter assembly driven transversely by a cut motor;

the cut motor being controlled by the blocking of a second electromagnetic beam by a user;

the cutter assembly further comprising a vertical cutter axle mounted between bearings in a housing, and a circular blade having a circular cutting edge mounted fixedly to the axle in concentric and perpendicular relation to the axle;

the cutter assembly slidably held by a traverse rod mounted on a first side of the sheet product transverse to the direction of advancement;

the traverse rod having opposite ends, and having at least one park position located at either or both opposite ends;

the means for cutting the sheet product transversely to the direction of advancement further comprising a fixed blade having a straight cutting edge mounted on a second side of the sheet product and transverse to the direction of advancement;

the traverse rod being mounted so as to bring the circular cutting edge into shearing engagement with the straight cutting edge along the entire length of the fixed blade, and so as to cut the sheet product fully transversely in one pass; and c) means for releasably clamping the sheet product above and below the straight cutting edge.

2. The dispenser of claim 1, wherein:

said cutter assembly further comprises an upper drive roller fixedly attached to said cutter axle above and parallel to said circular blade, and a lower drive roller fixedly attached to said cutter axle below and parallel to said circular blade; and said means for releasably clamping the sheet product above and below the straight cutting edge further comprises an upper clamping plate disposed parallel to said straight cutting edge on said first side of said sheet product;

the upper clamping plate being suspended pivotably from its upper edge so that it is spaced away from said sheet product when said cutter assembly is in said at least one park position and pressed against said sheet product by the upper drive roller when said cutter assembly is out of said at least one park position; and said means for releasably clamping the sheet product above and below the straight cutting edge further comprises a front lower clamping plate disposed parallel to, and below, the upper clamping plate, and a rear lower clamping plate disposed parallel to, and below, said straight cutting edge;

the lower front and lower rear clamping plates being suspended pivotably from their lower edges so that they are spaced apart from said sheet product when said cutter assembly is in said at least one park position and the lower front clamping plate is pressed against said sheet product and said sheet product is in turn pressed against the lower rear clamping plate by the lower drive roller when said cutter assembly is out of said at least one park position.

3. The dispenser of claim 2, wherein:

said means for actuating the advance motor further comprises means for preventing motion of said cutting assembly while said means for actuating the advance motor is actuated; and said means for preventing motion of said cutting assembly while said means for actuating the advance motor is actuated further comprises means for preventing actuation of said means for controlling the advance motor when said cutting assembly is out of said at least one park position.

4. The dispenser of claim 3, wherein:

said means for controlling the cut motor further comprises means for a) starting motion of said cutter assembly away from said at least one park position when said second beam is blocked and b) maintaining motion of said cutter assembly from said at least one park position through a designated cycle regardless of whether said second beam continues to be blocked.

5. The dispenser of claim 4, wherein:

said cycle comprises:

a) maintaining motion of said cut motor until said cutter assembly reaches a position on said traverse rod opposite to that of said at least one park position, whereupon b) said cutter assembly trips a means for reversing the motion of said cutter assembly, and c) said cutter assembly moves back to a median position along said rod, then stops.

6. The dispenser of claim 5, wherein:

said means for controlling the cut motor further comprises means for restarting the cut motor from said median position toward said at least one park position when said sheet product is withdrawn from between said lower front clamping plate and said lower rear clamping plate.

7. The dispenser of claim 6, wherein:

said means for restarting the cut motor further comprises a first electrical relay which responds to said lower front clamping plate coming into electrical contact with said lower rear clamping plate.

8. The dispenser of claim 7, wherein:

said openable cabinet further comprises:

means for returning said cutter assembly to said at least one park position when opening of said openable cabinet commences; and means for disconnecting all electric power from the dispenser when the openable cabinet is fully opened.

9. The dispenser of claim 8, further comprising:

means for lifting said pinch roller away from said advance roller while maintaining the axes of said pinch roller and said advance roller in substantially parallel relation, thereby forming a clear path between said advance roller and said pinch roller for feeding a sheet product therethrough by hand.

10. The dispenser of claim 9, wherein:

said means for actuating said advance motor further comprises:

a first electronic amplifier for amplifying a first signal from a first sensor of said first electromagnetic beam, the first signal being present only when said first electromagnetic beam is blocked;

an advance motor relay that is turned on by the amplified signal from the first electronic amplifier, causing electric power to flow through said advance motor, and turned off when the first signal is not present;

an advance motor brake relay that brakes said advance motor dynamically by grounding said advance motor when the advance motor relay is de-energized; and electrical connections between the advance motor brake relay and said means for controlling said cut motor that prevent said means for actuating said cut motor from being actuated while said means for actuating said advance motor is actuated.

11. The dispenser of claim 10, wherein:

said means for actuating said cut motor further comprises:

a second electronic amplifier for amplifying a second signal from a second sensor of said second electromagnetic beam, the second signal being initiated only when said second electromagnetic beam is blocked;

a right hand switch mounted at said at least one park position of said cutter assembly, a center switch mounted at said median position along said traverse rod, and a left hand switch mounted at the leftmost point of travel along said traverse rod, and a means for tripping switches mounted on said cutter assembly;

a cut motor relay that is turned on by the amplified signal from the second electronic amplifier, causing said cutter assembly to move leftward from said at least one park position, and maintained on until said means for tripping switches trips the left hand switch;

a cut motor brake relay that brakes said cut motor dynamically by grounding said cut motor when the cut motor relay is de-energized, then reverses current through said cut motor until said means for tripping switches trips either a) the center switch or b) the right hand switch.

12. The dispenser of claim 11, wherein:

said lower rear clamping plate and said lower front clamping plate are wired electronically to comprise a clamp switch that is in the open position when either a) said sheet product is held between them, or b) said cutter assembly is in said at least one park position; and the clamp switch uses a low voltage source to energize a clamp plate relay, which is connected to reenergize said cut motor relay.

13. The dispenser of claim 12, wherein:

said traverse rod is mounted within said openable cabinet on two springs, one at either end of said traverse rod and biasing said traverse rod in a horizontal direction towards said lower rear clamping plate, so as to press said upper and lower drive rollers with substantially constant force at all points along said traverse rod.

14. The dispenser of claim 13, wherein:

said circular blade has a first diameter, said upper drive roller has a second diameter, and said lower drive roller has a third diameter; and the second and third diameters are less than the first diameter.

15. The dispenser of claim 14, wherein:

the edge of said fixed blade is at least 4 Rockwell C units harder than the edge of said circular blade.

16. The dispenser of claim 15, wherein:

said lower front clamping plate and said lower rear clamping plate further comprise cutout portions for the release of accumulated dust.

17. The dispenser of claim 14, wherein:

said openable cabinet further comprises:

a rectangular box divided substantially in half by an horizontal divider, forming an upper portion and a lower portion, the box also having a right side and a left side;

the front of the upper space being openably covered by a door;

the door having affixed to it on either of its sides downwardly-extending arms, the arms wrapping around the outsides of the lower portion along the right and left sides, each arm having a proximal end affixed to the door and a distal end;

the door being pivotably fixed to each side by a pin near the proximal end of each arm, so that the door may open downwardly from the front of the upper space to a substantially horizontal plane, the distal ends of the arms rising to a substantially horizontal plane;

said means for lifting said pinch roller away from said advance roller while maintaining the axes of said pinch roller and said advance roller in parallel relation comprising right and left L-shaped tabs affixed to the distal ends of the arms;

said pinch roller axle having a right end and a left end, each end protruding through elongate slots in the right and left sides, respectively, of the box; and said right and left L-shaped tabs engaging and lifting the right and left ends of said pinch roller axle within the slots when said door is opened downwardly to a substantially horizontal plane.

18. The dispenser of claim 17, wherein:

said means for returning said cutter assembly to said at least one park position when opening of said openable cabinet commences comprises a first switch that is held closed by one of said distal ends when said door is closed, and opens when opening of said door commences, actuating said means for restarting the cut motor; and said means for disconnecting all electric power comprises a second switch that is open when said means for lifting said pinch roller is disengaged from said axle, and closed by said axle when said axle is raised by said L-shaped tabs when said door is opened.

19. The dispenser of claim 14, wherein:

said openable cabinet further comprises:

a rectangular housing into which slidingly fits a rectangular drawer;

the drawer bounded on its sides by right and left panels;

said pinch roller axle having a right and a left end, the ends protruding through elongate right and left slots in the panels, respectively;

said means for lifting said pinch roller away from said advance roller while maintaining the axes of said pinch roller and said advance roller in substantially parallel relation comprising right and left crank plates being pivotably affixed to the respective panels, the crank plates having right and left L-shaped tabs, right and left tangs, and right and left springs affixed thereto, the springs biasing the crank plates rotationally so as to cause the tabs to engage the right and left ends of said pinch roller axle and lift them when the drawer is outside the housing; and the housing having right and left inner catches that engage the right and left tangs, respectively, on the crank plates when the drawer is inserted fully into the housing, the tangs rotating the crank plates against the spring bias and lowering said pinch roller.

20. The dispenser of claim 19, wherein:

said means for returning said cutter assembly to said at least one park position comprises a third switch that is open until said axle is raised by said L-shaped tabs when said drawer is pulled out of said housing, closing the third switch and actuating said means for restarting the cut motor; and said means for disconnecting all electric power comprises a contact strip mounted on said drawer that maintains electrical contact with a power source in said housing when said drawer is within said housing, and ceases electrical contact when said drawer is withdrawn from said housing.

* * * * *